US009365061B2

(12) United States Patent
King et al.

(10) Patent No.: US 9,365,061 B2
(45) Date of Patent: Jun. 14, 2016

(54) EXTERNAL TABLE HEIGHT ADJUSTMENT FOR PRINTER SYSTEMS

(71) Applicant: ELECTRONICS FOR IMAGING, INC., Fremont, CA (US)

(72) Inventors: Gregg King, Sanbornton, NH (US); Rob Whitten, Citrus Springs, FL (US); Timothy Madan, Chicago, IL (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 14/178,236

(22) Filed: Feb. 11, 2014

(65) Prior Publication Data

US 2015/0224799 A1 Aug. 13, 2015

(51) Int. Cl.
*B41J 25/308* (2006.01)
*B41J 11/20* (2006.01)

(52) U.S. Cl.
CPC ..... *B41J 25/308* (2013.01); *B41J 11/20* (2013.01)

(58) Field of Classification Search
CPC ..... B41J 11/06; B41J 11/14; B41J 25/308; B41J 11/04; B41J 11/20
USPC ..... 347/8, 104
See application file for complete search history.

(56) References Cited

U.S. PATENT DOCUMENTS

| | | | | |
|---|---|---|---|---|
| 5,274,300 | A | 12/1993 | Dodds et al. | |
| 5,274,399 | A * | 12/1993 | Uchida | B41J 29/02 101/297 |
| 5,854,643 | A | 12/1998 | Katsuyama et al. | |
| 6,171,001 | B1 | 1/2001 | Nonaka et al. | |
| 6,394,568 | B1 | 5/2002 | Menéndez et al. | |
| 8,186,787 | B2 | 5/2012 | Holbrook et al. | |
| 2007/0048057 | A1 | 3/2007 | Youn et al. | |

* cited by examiner

*Primary Examiner* — Jannelle M Lebron
(74) *Attorney, Agent, or Firm* — Michael A. Glenn; Perkins Coie LLP

(57) ABSTRACT

An external table height adjustment technique for a printer system is disclosed. An operator can align an image gap between a printer table of the printer system and a printhead carriage via a height adjustment mechanism. The operator can perform the table height adjustment while a belt is installed on the printer table and media is loaded on top of the printer table. A height adjustment assembly is secured onto a supporting frame of the printer table such that an adjustment component exposed beyond an edge of the belt can raise or lower a portion of the printer table where the height adjustment assembly is secured.

8 Claims, 15 Drawing Sheets

900A

900B

EXTERNAL TABLE HEIGHT ADJUSTMENT FOR PRINTER SYSTEMS

RELATED FIELD

This disclosure relates generally to printer alignment systems and in particular to a technique of printer table height adjustment.

BACKGROUND

A printer system may require precise alignment of a printer table or roller relative to the printheads. The precise alignment ensures a constant height between the printer table and the printhead nozzles such that inkjet dots have a consistent shape and are accurately placed. Conventionally, setting an image plane on hybrid tables with belts requires the belt to be removed. An operator can measure the table height and make best guess adjustments after the belt is removed. Thereafter, the belt is reassembled and the entire system is revalidated. This conventional process is time-consuming and inaccurate, causing a large variation in terms of alignment.

SUMMARY

Disclosed is a technique for precision alignment of printer table/rollers to the printheads utilizing an external table height adjustment mechanism. Such precise alignment may be part of the manufacturing and quality control process of building printer systems. Such precise alignment may also be part of a printer system maintenance process. Particularly, the disclosed mechanism facilitates precise control of the image plane gap, thus considerably improving upon dot placement accuracy, which impacts everything from color variation, to gloss, and to overall image quality of the printed results.

The disclosed technique includes adjustment of the image plane via the height adjustment mechanism after the belt has been installed and while media is positioned on the printer table with vacuum pull. The height adjustment mechanism allows for the height from the image plane to the printhead nozzles to be precisely adjusted. Being able to externally adjust the image plane gap with the belt installed greatly improves dot placement while decreasing the costly trial and error adjustment process with the removal of the belt. The external table height adjustments account for imperfections in tables and rollers of printer systems, as well as the imperfections in the bar that holds the printhead carriage. The disclosed technique cures these imperfections quickly during the quality control process of manufacturing or during maintenance operations.

The disclosed height adjustment mechanism may include multiple adjustment assemblies located across and underneath the printer table. Each adjustment assembly may be controlled via an adjustment nut on or in contact with (directly or indirectly) a side plate of the printer table frame. For example, the adjustment assembly may include a long rod through the adjustment nut such that the rotation of the adjustment nut can change the height of the adjustment assembly. The adjustment assemblies may be used to adjust the printer table to conform the image gap from the printhead nozzle locations to any point over the image plane. This process reduces production time of these printer systems, enables the ability to precisely place dots, and increases the printing consistency of the printer systems.

Some embodiments of this disclosure have other aspects, elements, features, and steps in addition to or in place of what is described above. These potential additions and replacements are described throughout the rest of the specification.

The figures depict various embodiments of the present disclosure for purposes of illustration only. One skilled in the art will readily recognize from the following discussion that alternative embodiments of the structures and methods illustrated herein may be employed without departing from the principles of the invention described herein.

DETAILED DESCRIPTION

Figure 1:
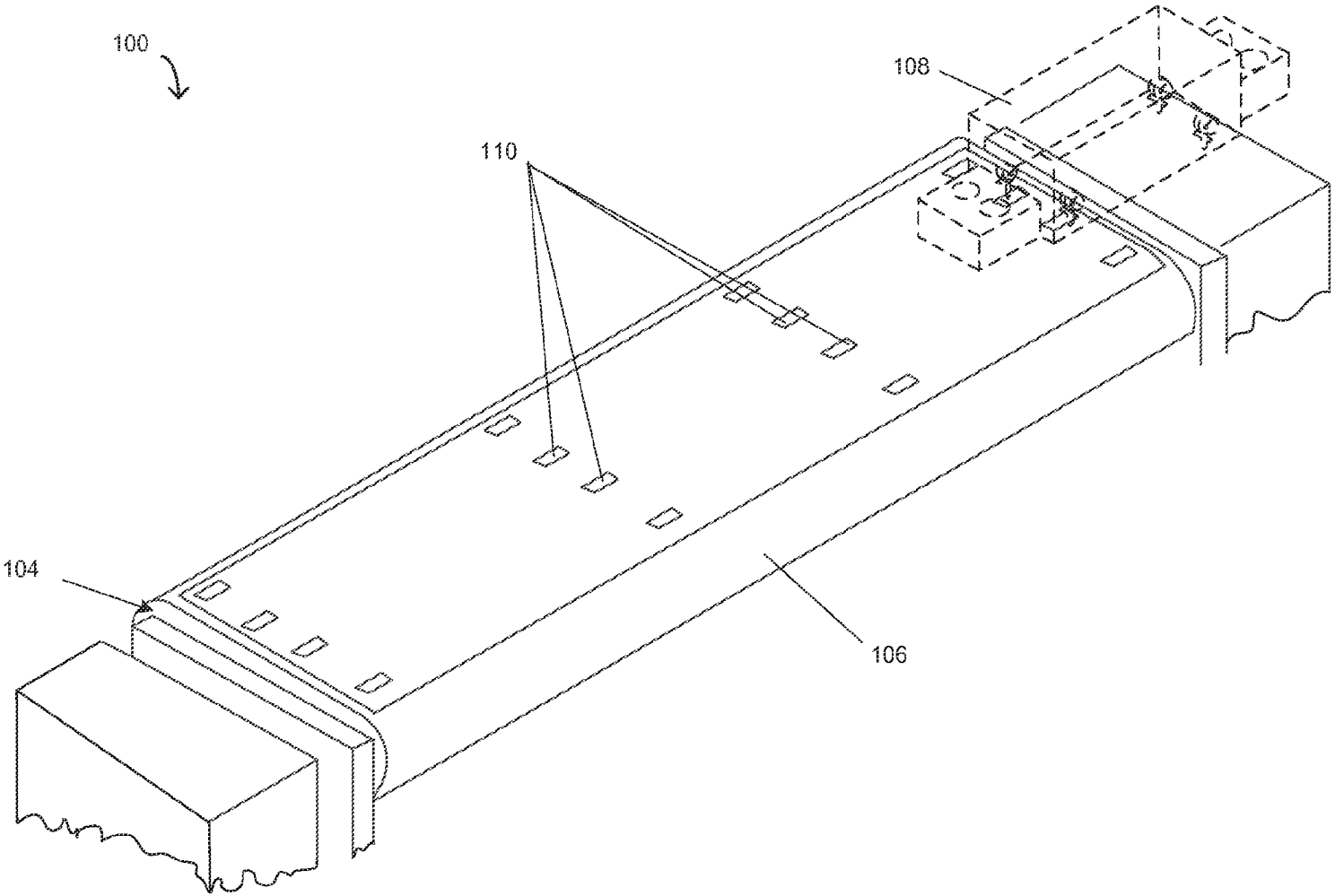
FIG. 1 is a perspective view of a portion of a printer system with a vacuum table.

FIG. 1 is a perspective view of a portion of a printer system 100 with a printer table 104. The printer system 100 can be a grand format printer, a wide format printer, a screen printer, or any other type of inkjet printer. The printer table 104 is a structure with a substantially flat surface for carrying a substrate or media. The printer table 104 may be coupled to a vacuum blower to create a vacuum pull to secure the substrate or media on the printer table 104. A belt 106 may be installed on the printer table 104. The belt 106 can be an endless belt. The belt 106 can convey the substrate or media towards or away from a carriage 108. The carriage 108 is a movable component of the printer system 100. The carriage 108 contains the printheads of the printer system 100. The carriage 108 can scan across over the substrate or media in directions substantially perpendicular to the movement direction of the belt 106. For example, the carriage 108 can glide along a carriage bar (not shown) over the printer table 104.

FIG. 1 also illustrates adjustment locations 110 over the printer table 104 along the width of the belt 106. The adjustment locations 110 are positions on the printer table 104 where height distances between the printer table 104 and the carriage 108 are measured for the purpose of table alignment.

For the purpose of this disclosure, a direction of travel for a top surface of the belt 106 facing the carriage 108 may be referred to as "backward" and an opposite direction from that may be referred to as "forward." The direction towards one end of the belt 106 (e.g., away from the illustrated position of the carriage 108) may be referred to as the "left" side, and the direction towards the other end of the belt 106 e.g., at the illustrated position of the carriage 108) may be referred to as the "right" side. It is noted, however, the terms "forward," "backward," "left," and "right" are used to distinguish one end of a structure from another without necessarily requiring or implying a direction from an operator's perspective.

Figure 2A:
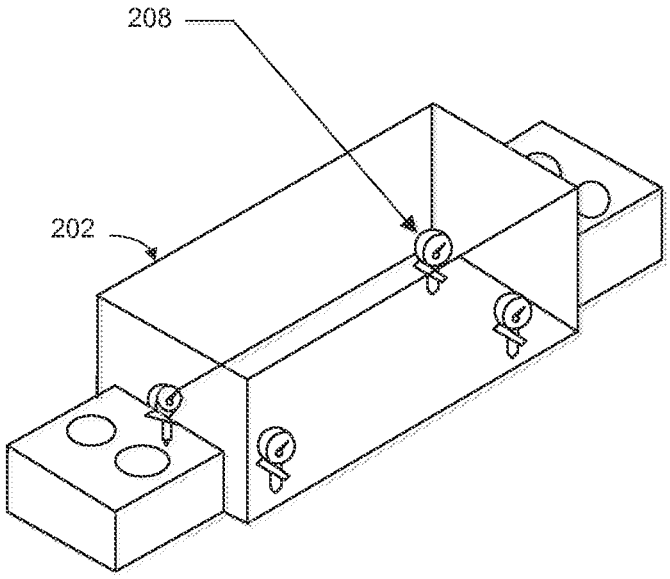
FIG. 2A is a perspective view of a printhead carriage.

FIG. 2A is a perspective view of a printhead carriage 202. The printhead carriage 202 may be the carriage 108 of FIG. 1. The printhead carriage 202 includes or is attached to dial indicators 208. The dial indicators 208 are instruments used to accurately measure small distances and/or angles. The printhead carriage 202 can include exactly four or any other number of dial indicators. For example, the dial indicators 208 can be positioned towards four corners of the printhead carriage 202. The dial indicators 208 may include a dial display, in which a needle points to graduations in a circular array around the dial display. The dial indicators 208 may electronically output the measurements to an alignment system (not shown) acting as an operator of the printer system for the purpose of table alignment. The operator of a printer system, such as the printer system 100 of FIG. 1, can use the dial indicators 208 to measure the gap distance from the printhead nozzles 210 to a printer table, such as the printer table 104 of FIG. 1.

Figure 2B:
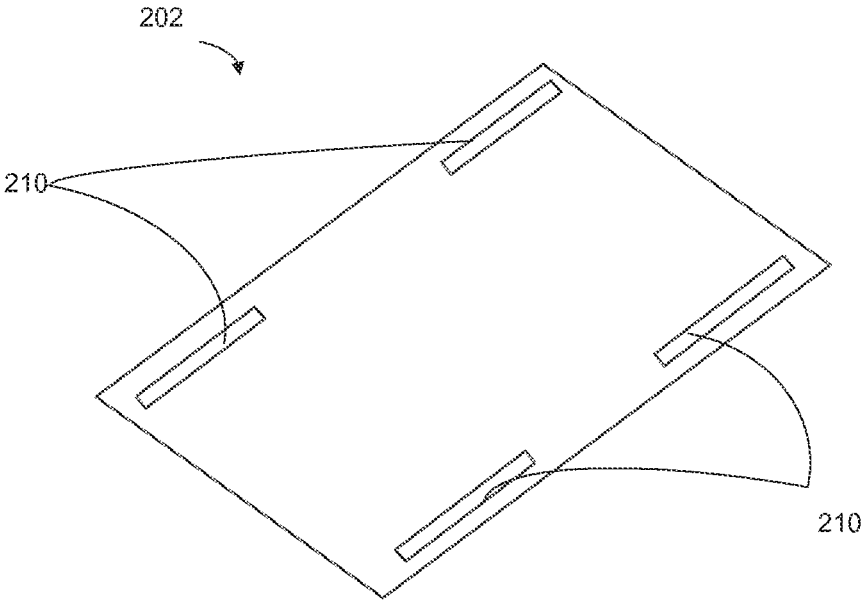
FIG. 2B is a perspective plan view of where printhead nozzles of the printhead carriage of FIG. 2A are located.

FIG. 2B is a perspective plan view of where printhead nozzles 210 of the printhead carriage 202 of FIG. 2A are located. The printhead nozzles 210 can correspond respectively to different colors of inkjets, such as magenta, yellow, cyan, and black. This disclosure also contemplates any other combination of printheads and/or inkjet colors. The dial indicators 208 can be aligned with the positions of the printhead nozzles 210, such as at the corners of the printhead nozzles 210, for the purpose of table height measurement.

Figure 3:
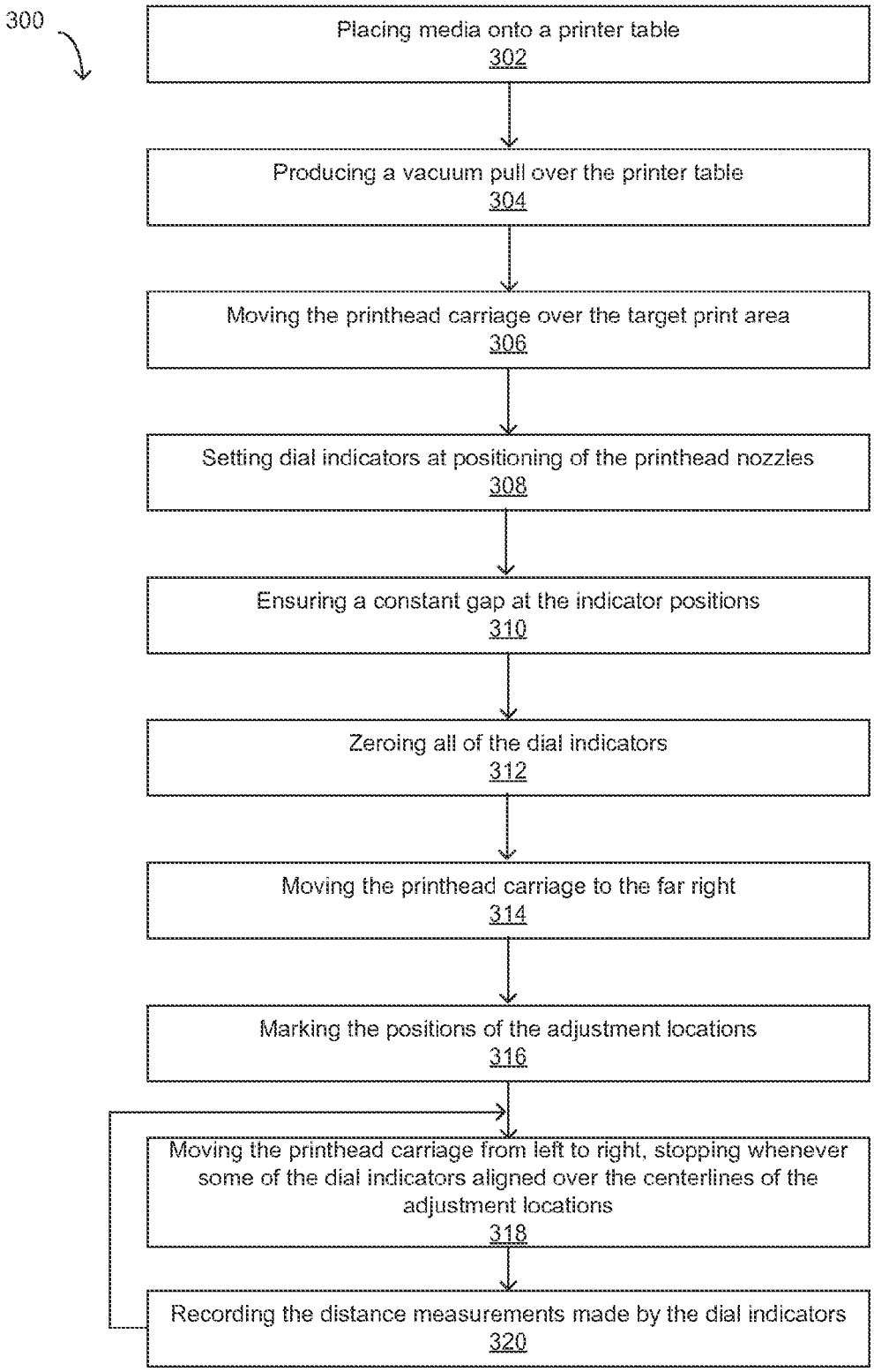
FIG. 3 is a flow chart of a process of measuring table height of a printer system.

FIG. 3 is a flow chart of a process 300 of measuring table height of a printer system, such as the printer system 100 of FIG. 1. The table height to be measured may be a distance from the top flat surface of a printer table (e.g., the printer table 104 of FIG. 1) to printhead nozzles (e.g., the printhead nozzles 210 of FIG. 2) of the printer system. The process 300 begins with placing a piece of media onto the printer table in step 302. In response to a command, the printer system can produce a vacuum pull over the printer table to hold the media in place in step 304.

An operator can move a printhead carriage, such as the printhead carriage 202 of FIG. 2, over the target print area on the printer table in step 306. The "operator" referenced in this disclosure refers to a person, an electronic and/or mechanical alignment system, the printer system, or a combination thereof. The printhead carriage includes or is attached to dial indicators, such as the dial indicators 208 of FIG. 2. The dial indicators can be set at positions of the printhead nozzles in step 308. For example, the positions can include the positions of the printhead nozzles illustrated in FIG. 2. The operator can then ensure a constant gap at the indicator positions in step 310. For example, the constant gap can be exactly or substantially near 0.060 inches.

The operator then zeroes all of the dial indicators, in step 312, and proceeds to move the printhead carriage to the far right of the printer table in step 314. The operator marks the positions of the adjustment locations, such as the adjustment locations 110 of FIG. 1, in step 316. For example, the positions can be marked and recorded as distances along and from (e.g., on a Cartesian coordinate) the left edge of a belt on the printer table, such as the belt 106 of FIG. 1. The printhead carriage can then be moved, in step 318, from right to left, stopping whenever at least some of the dial indicators aligned over the centerlines of the adjustment locations. In some embodiments, the movement may include forward and backward as well. Whenever at least two of the dial indicators are aligned over the centerlines of the adjustment points, the operator can record, in step 320, the distance measurements made by the dial indicators. In alternative embodiments, a pinpoint laser measurement or alignment tool can be used instead or in combination with the dial indicators to measure the distances.

Step 318 and step 320 may be repeated until distance measurements are recorded for all adjustment points. For example, there can be a total of 8 measurements in the illustrated example (e.g., two measurements, front and back of the carriage, for each pair of the adjustment locations). The printhead carriage is left at the far left position when all measurements are completed.

Figure 4A:
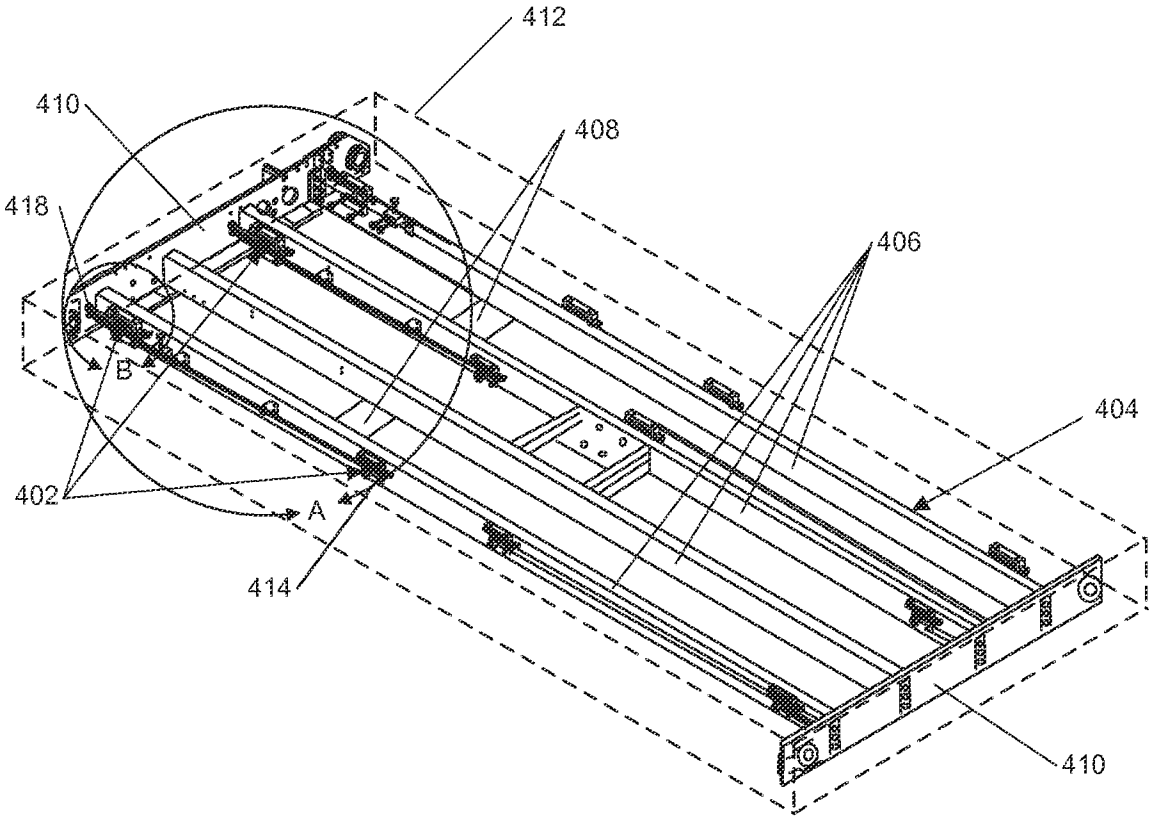
FIG. 4A is a perspective plan view of a printer table with external height adjustment mechanisms.

FIG. 4A is a perspective plan view of a printer table 400 with external height adjustment mechanisms 402. Detailed views of the printer table 400 are further illustrated in FIGS. 7A-7C. The printer table 400 includes a supporting structure 404, such as a metallic frame. For example, the supporting structure 404 may include four lengthwise bars 406 and several linkage bars 408 therebetween. Structural linkages can hold the supporting structure 404 together with two side plates 410 opposite to one another. The side plates 410 attach the printer table 400 to the rest of a printer system. The printer table 400 may include a shell 412. The shell 412 can cover at least a top portion of the printer table 400. The shell can also interface with a belt, such as the belt 106 of FIG. 1, which can be installed on the printer table 400 to convey a substrate or media.

The external height adjustment mechanisms 402 are distributed in multiple locations on the supporting structure 404. Each external height adjustment mechanism includes at least a height adjustment assembly 414 and an adjustment nut 418. The height adjustment assembly 414 is attached to the printer table 400 to raise or lower a portion of the printer table 400. For example, the height adjustment assembly 414 can push or pull against the shell 412 covering the printer table 400. The adjustment nut 418 is coupled to the height adjustment assembly 414 such that turning the adjustment nut 418 controls the lowering or raising of the printer table 400. In various embodiments, the adjustment nut 418 is turned in conjuction with a bolt nut (not shown) on the other side of the side plates 410. This is further illustrated in FIG. 8B.

An operator aligning the printer table 400 can externally adjust each of the external height adjustment mechanisms 402 via the adjustment nut 418 corresponding to a specific adjustment location on the printer table 400. The specific adjustment locations indicate where instances of the height adjustment assembly 414 are installed. For example, the adjustment locations can be the adjustment locations 110 of FIG. 1.

Figure 4B:
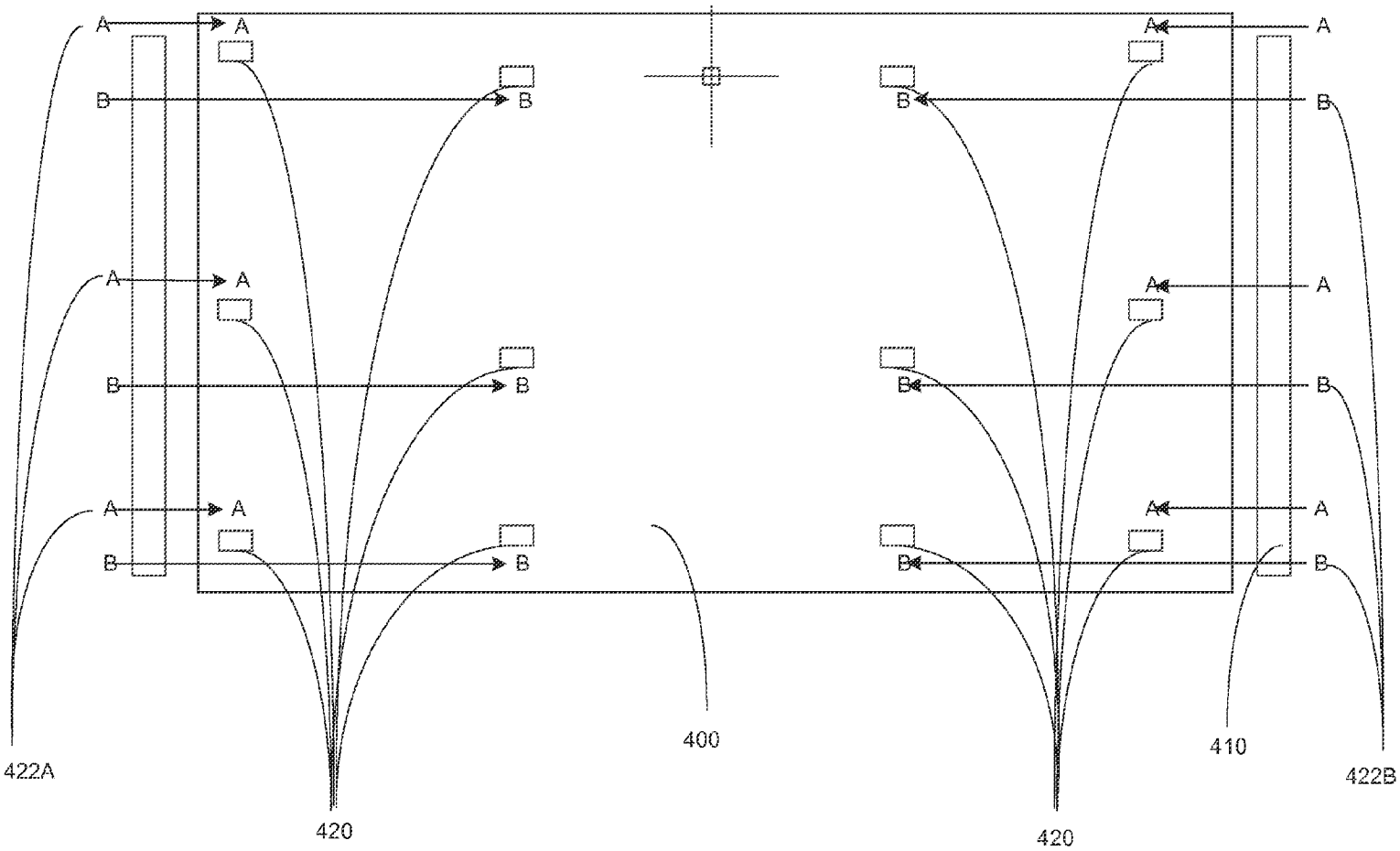
FIG. 4B is a spatial map illustrating a top plan view of the printer table of FIG. 4A and exemplary locations of the external height adjustment mechanisms.

FIG. 4B is a spatial map illustrating a top plan view of the printer table 400 of FIG. 4A and exemplary locations 420 of the external height adjustment mechanisms 402. FIG. 4B illustrates twelve adjustment locations 420 spread out through the printer table 400. Along each of the side plates 410, the locations labeled with the letter "A" correspond to a top set of adjustment nuts 422A. The top set of adjustment nuts 422A can correspond to outboard adjustment locations 420A. The outboard adjustment locations 420A are the adjustment locations 420 that are closest to the edge of the printer table 400.

Along each of the side plates 410, the locations labeled with the letter "B" correspond to a bottom set of adjustment nuts 422B. The bottom set of adjustment nuts 422B can correspond to inboard adjustment locations 420B. The inboard adjustment locations 420B are the adjustment locations 420 that are closest to the center of the printer table 400.

Figure 5:
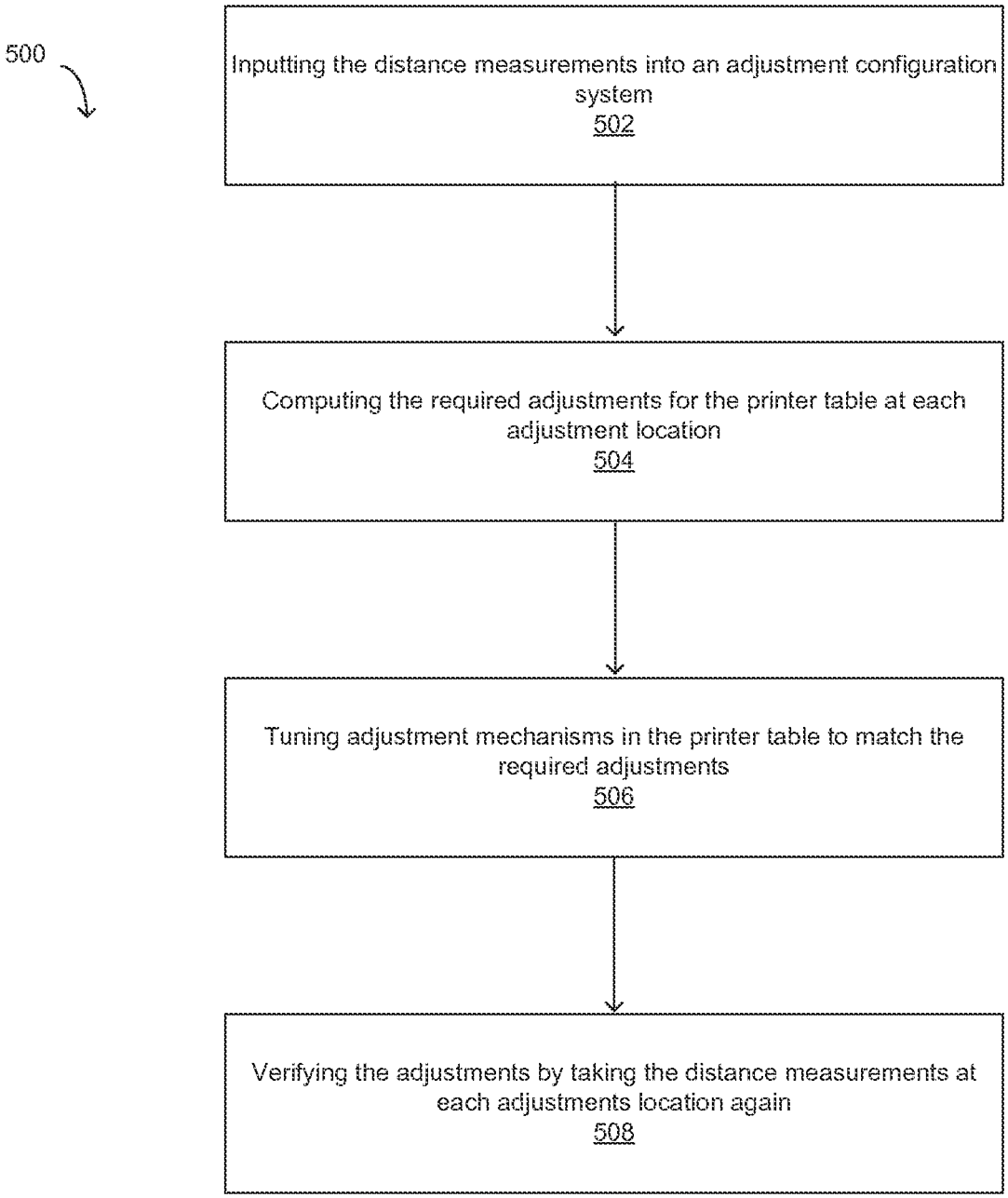
FIG. 5 is a flow chart of a process of adjusting the table height of a printer system after a belt is installed on the table.

FIG. 5 is a flow chart of a process 500 of adjusting the table height of a printer system after a belt is installed on a printer table of the printer system. The printer table can be the printer table 104 of FIG. 1 or the printer table 400 of FIG. 4. The process 500 may depend on the table height measurements taken via performing the process 300 of FIG. 3. The process 500 begins with inputting the distance measurements from process 300 into an adjustment configuration system in step 502. The adjustment configuration system can be a computing device, such as a laptop, a desktop computer, or a computing server. Upon receiving the distance measurements, the adjustment configuration system computes and displays, in step 504, the required adjustments for the printer table at each adjustment location, such as the adjustment locations 110 of FIG. 1 or the adjustment locations 420 of FIG. 4B.

In response step 504, an operator of the printer table can tune adjustment mechanisms, such as the height adjustment mechanisms 402 of FIG. 4A, in the printer table, in step 506, to match the required adjustments. For example, the height adjustment mechanisms can include adjustment nuts, such as the adjustment nut 418 of FIG. 4A, respectively controlling height adjustment assemblies at the adjustment locations. The adjustment nuts are located alongside side plates of a supporting frame (e.g., the supporting structure 404 of FIG. 4A) of the printer table. As part of the adjustment step 506, the operator can turn the adjustment nuts in accordance with the required adjustments and an adjustment ratio. For example, the adjustment ratio may dictate that a 90° turn of each adjustment nut corresponds to 0.005" of height adjustment.

Figure 6:
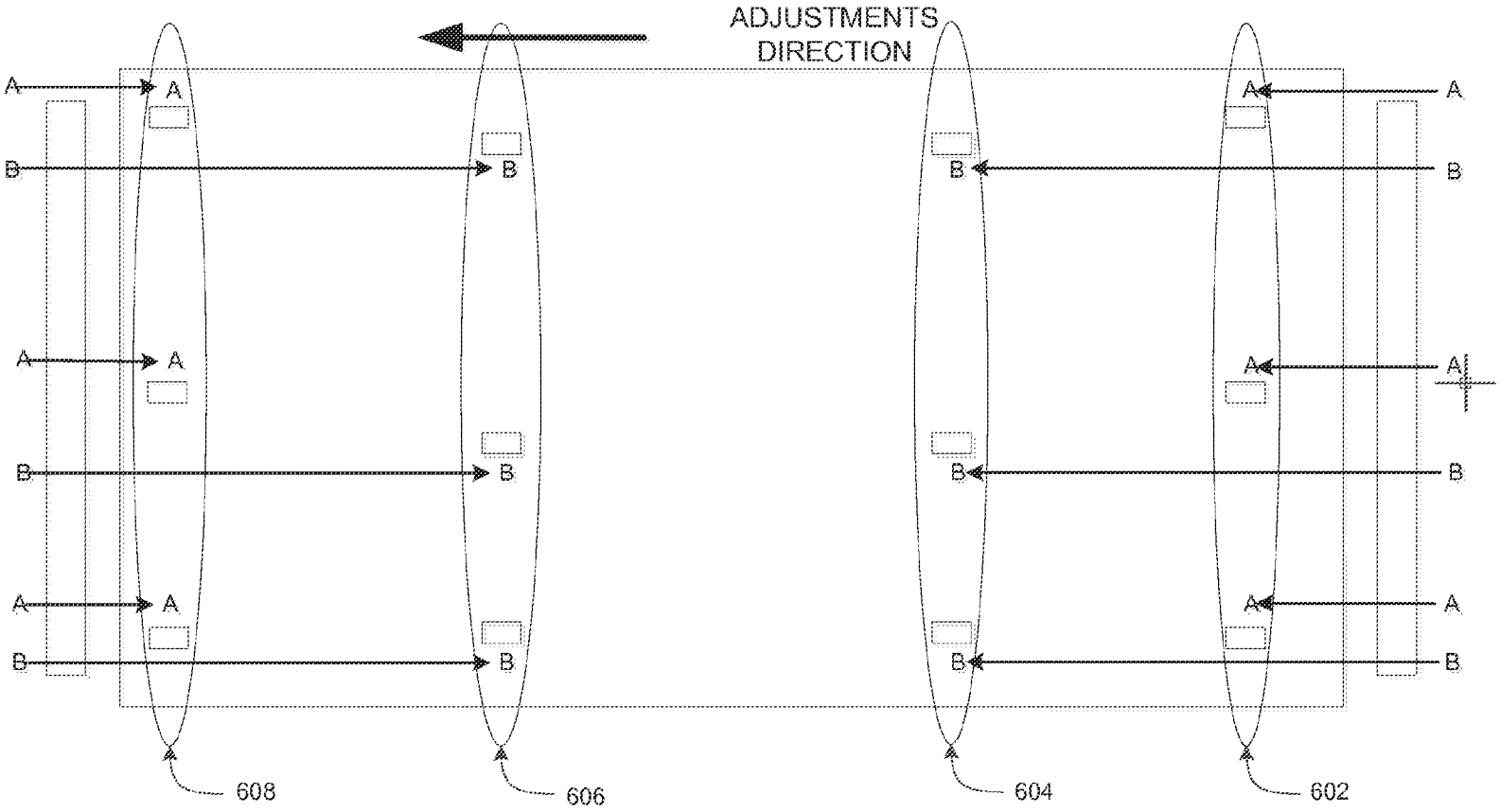
FIG. 6 is a diagram illustrating the adjustment sequence as applied to the printer table of FIG. 4

In at least some embodiments, the adjustments are made on the printer table in a single direction (e.g., from right to left or left to right) such that the printer table is stretched in one direction only. For example, FIG. 6 is a diagram illustrating the adjustment sequence as applied to the printer table 400 of FIG. 4A. In the beginning of step 506, the operator performs a first set of adjustments 602 on the right most adjustment locations. Then the operator moves on to a second set of adjustments 604, a third set of adjustments 606, and a fourth set of adjustments 608 until all of the required adjustments are completed.

The operator verifies the adjustments in step 508 by taking the distance measurements at each of the adjustment locations in a similar fashion as the process 300 of FIG. 3. In some embodiments, the operator verifies the adjustments in a direction opposite to the direction of the distance measurements. For example, if the distance measurements are taken with the carriage moving from the right side of the printer table to the left side, then the verification measurements can be taken with the carriage moving from the left side of the printer table to the right side.

The operator of the described processes can be a person, an automated electronic/mechanical machine, an electronic component of the printer system, or a combination thereof. The operator may describe a person operating an alignment system, where a processor, a controller, or other electronic circuitry can implement the alignment system. The processes described can be manual, semi-automatic, or automated. For example, the processes can be implemented as a set of instructions, stored on a memory, which can be executed by a processor. The processes described involving the printer table may equally apply to printer rollers as well. The processes described involving the dial indicators may equally apply where the dial indicators are replaced by other distance measuring devices, such as pinpoint laser measurement devices.

While steps or blocks are presented in FIGS. 3 and 5 in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times. Further, any specific numbers noted herein are only examples: alternative implementations may employ differing values or ranges.

Figure 7A:
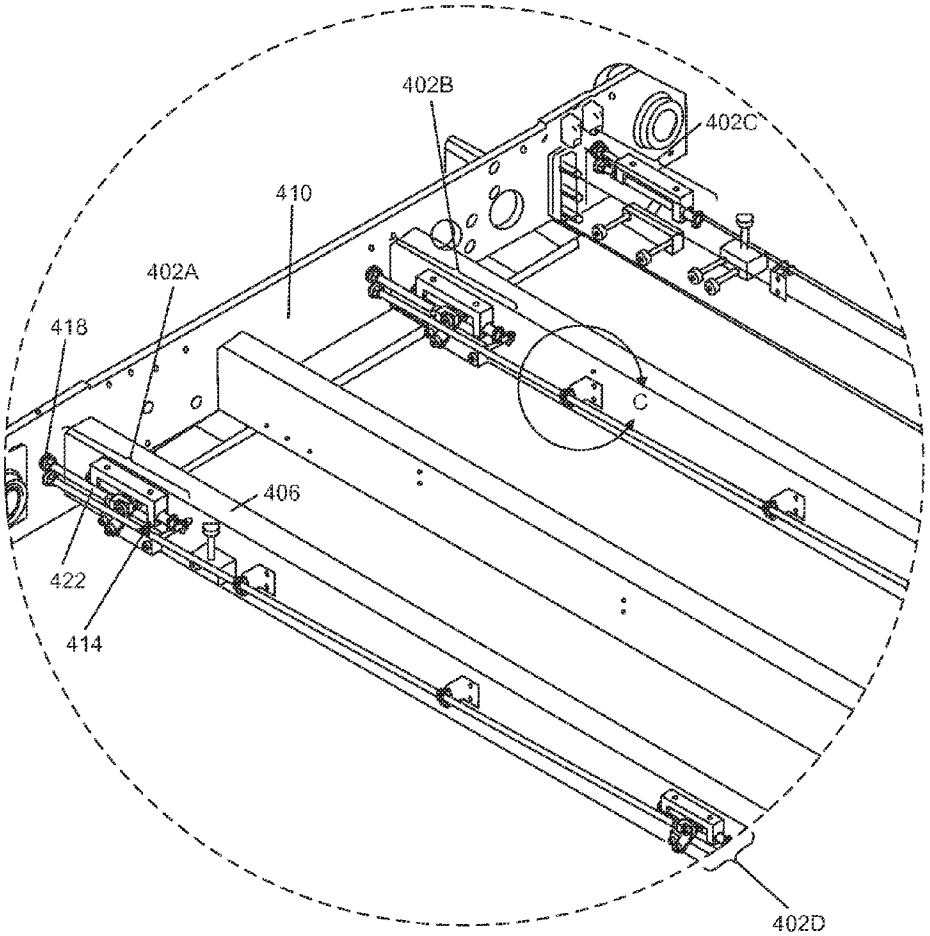
FIG. 7A is a first detailed perspective view of the printer table of FIG. 4A.

FIG. 7A is a first detailed perspective view of the printer table 400 of FIG. 4A. Specifically, FIG. 7A is a detailed diagram of the area labeled "A" circled in FIG. 4A. Illustrated are at least four height adjustment mechanisms 402 labeled 402A, 404B, 402C, and 402D respectively. As shown, an instance of the adjustment nut 418 is mounted through one of the side plates 410. The adjustment nut 418 controls lateral movement of the rod 422. The rod 422 is a part of the height adjustment assembly 414. The rod 422 can run parallel to one of the lengthwise bars 406.

Figure 7B:
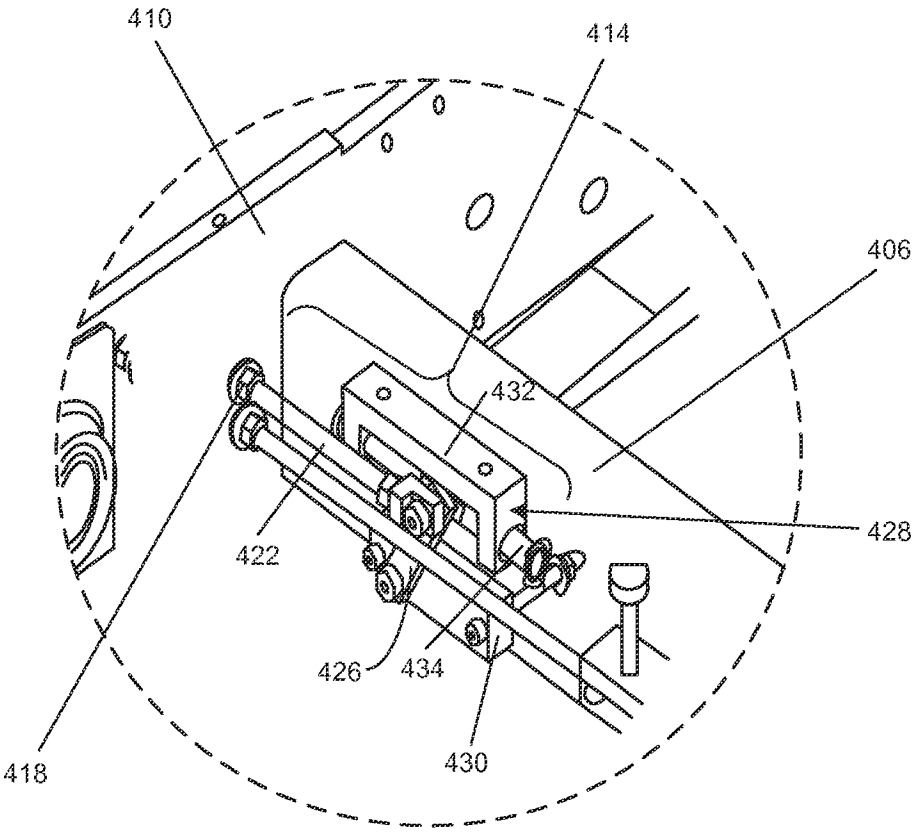
FIG. 7B is a second detailed perspective view of the printer table of FIG. 4A.

FIG. 7B is a second detailed perspective view of the printer table 400 of FIG. 4A. Specifically, FIG. 7B is a detailed diagram of the area labeled "B" circled in FIG. 4A. As shown, the rod 422 terminates on a linkage structure 426. The linkage structure 426 is a part of the height adjustment assembly 414. The linkage structure 426 couples to a table interface 428 and a frame interface 430 of the height adjustment assembly 414. The linkage structure 426 can be attached via shoulder screws on both ends, one to the table interface 428 and one to the frame interface 430.

The table interface 428 is a structure that attaches to a top portion of the printer table 400, such as the shell 412. The table interface 428 includes a mounting bracket 432 and a thermal expansion compensation pin 434. The mounting bracket 432 can be attached to the shell 412. The thermal expansion compensation pin 434 can run through two ends of the mounting bracket 432. The linkage structure 426 can be attached to the thermal expansion compensation pin 434. The frame interface 430 is a mounting block that attaches to one of the lengthwise bars 406 of the supporting structure 404. The described components can be attached to each other in a variety of ways, including mechanical attachments (e.g., shoulder screws) and adhesive attachments (e.g., glue). The linkage structure 426 can be attached using a screw or hinge that enables the attached linkage structure 426 to rotate/pivot at the points of attachment to either the thermal expansion compensation pin 434 or the frame interface 430.

The adjustment nut 418 can be adapted such that turning the adjustment nut 418 clockwise would pull the rod 422 towards the adjustment nut 418 and turning the adjustment nut counter-clockwise would push the rod 422 away from the adjustment nut 418. In various embodiments, the adjustment nut 418 is turned in conjuction with a bolt nut (not shown) around the rod 422 on the opposite side of the side plate 410.

In the illustrated configuration, when the rod 422 is pulled, the linkage structure 426 straightens and raises the table interface 428. When the rod 422 is pushed, the linkage structure 426 slants and lowers the table interface 428.

Figure 7C:
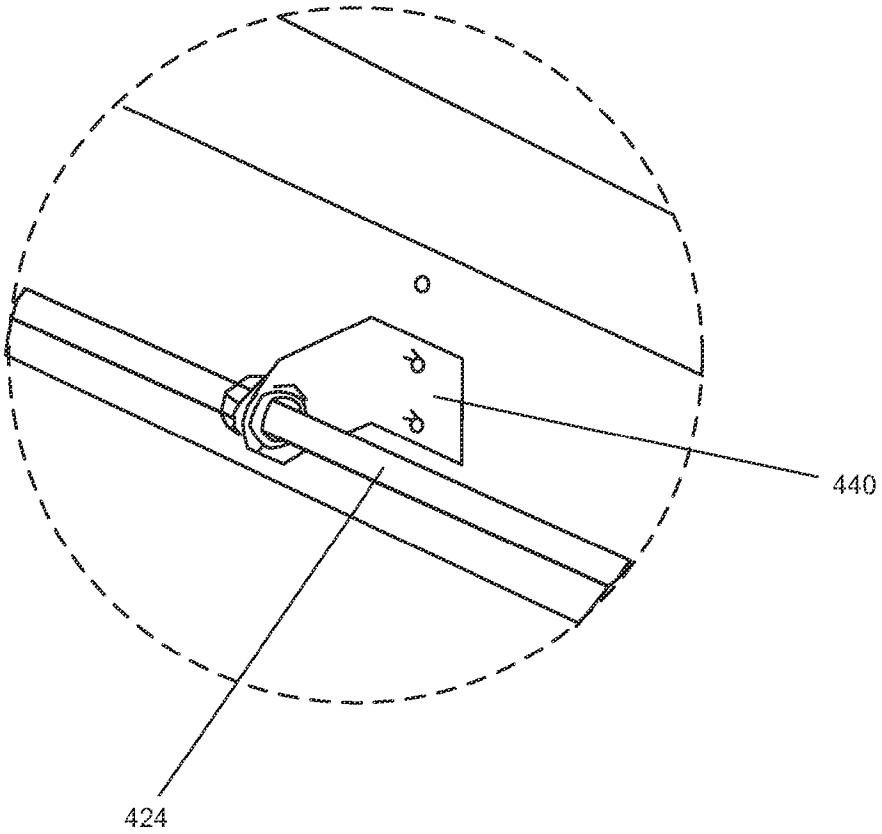
FIG. 7C is a third detailed perspective view of the printer table of FIG. 4A.

FIG. 7C is a third detailed perspective view of the printer table 400 of FIG. 4A. Specifically, FIG. 7C is a detailed diagram of the area labeled "C" circled in FIG. 7A. FIG. 7C illustrates the rod 422 that extends from the adjustment nut 418 (not shown this figure) towards one instance of the height adjustment assembly 414 (not shown in this figure). The rod 422 can be held in place by a corner bracket 440. The corner bracket 440 is attached to one of the lengthwise bars 406. The corner bracket 440 may serve as a rod guide to mitigate the bending of the rod 422, especially for instances of the rod 422, which extends farther towards the inner/central portion of the printer table 400. The rod 422 traverses through a hole in the corner bracket 440. The corner bracket 440 holds the rod 422 in place vertically while allowing the rod 422 to extend or retract based on rotation of the adjustment nut 418.

Figure 8A:
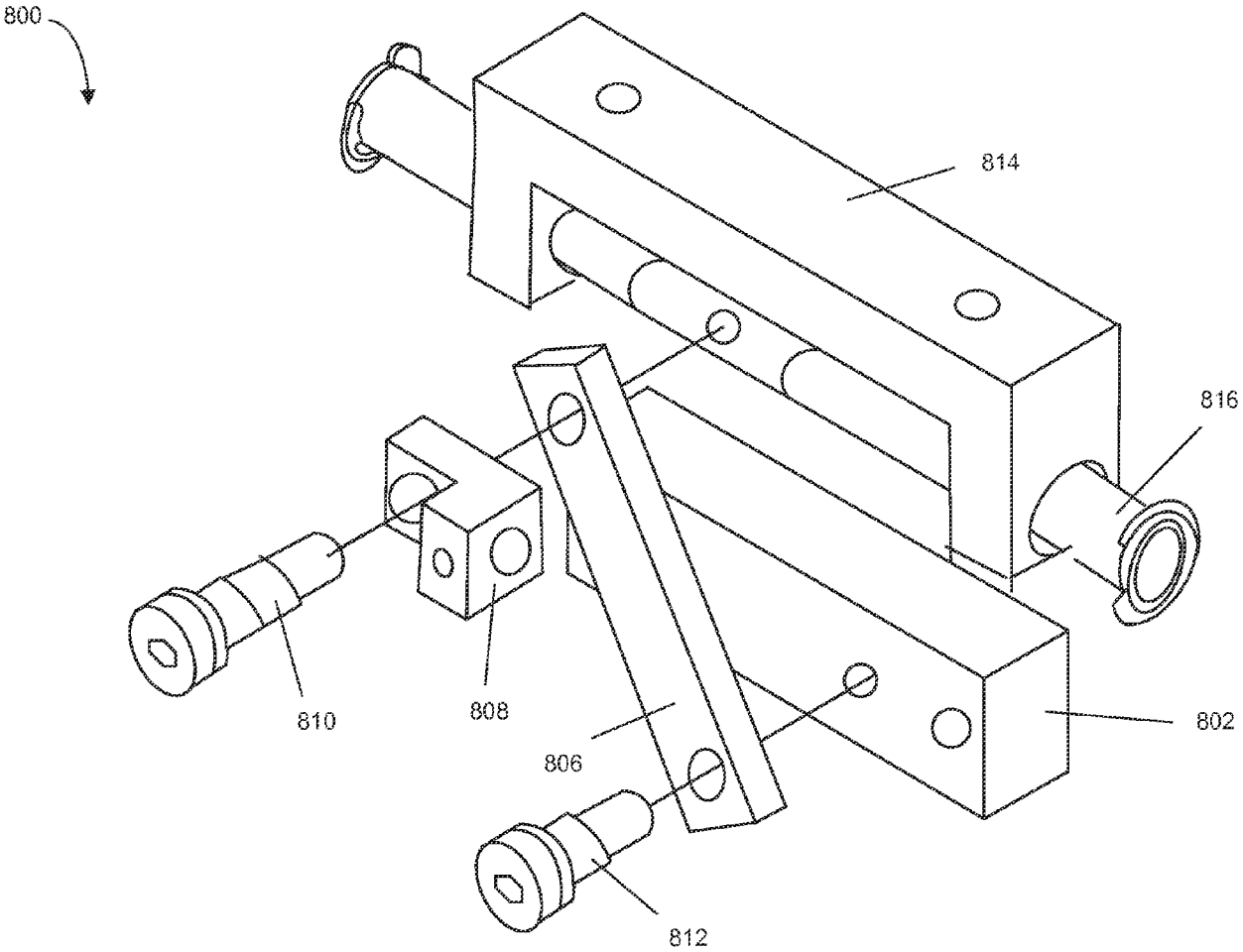
FIG. 8A is a components diagram illustrating a partial assembly of a height adjustment mechanism.

FIG. 8A is a components diagram illustrating a partial assembly of a height adjustment mechanism 800 for a printer table. The printer table can be the printer table 400 of FIG. 4A. The height adjustment mechanism 800 can be one of the external height adjustment mechanisms 402 of FIG. 4A. The height adjustment mechanism 800 includes a frame interface 802, a table interface 804, a linkage 806, a rod interface 808, a first shoulder screw 810, and a second shoulder screw 812. The table interface 804 may include a mounting bracket 814 and a compensation pin 816. The components of the height adjustment mechanism 800 may be consistent with the components of the height adjustment mechanisms 402 of FIG. 4A.

The mounting bracket 814 can be a rigid structure with two arms extending from both ends of a center portion. Each arm can form a right angle with the center portion. Each arm includes a hole. The compensation pin 816 passes through both of the holes. The compensation pin 816 includes an off-center tapped hole adapted to fit the first shoulder screw 810. The tapped hole may be surrounded by a flattened groove in the compensation pin 816. The center portion may include one or more holes, such as tapped holes, so that screws, pins, or nails can traverse through the one or more holes to attach the mounting bracket 814 to a shell of the printer table, such as the shell 412 of the printer table 400.

The linkage 806, the rod interface 808, and the compensation pin 816 can be held together by inserting the first shoulder screw 810 through a first hole in the rod interface 808 and a first hole in the linkage 806, and screwing the first shoulder screw 810 into the tapped hole of the compensation pin 816. The rod interface 808 may be an L-shape block having two sides perpendicular to each other. The rod interface 808 includes a first hole through the first side and a second hole through the second side. The second hole of the rod interface 808 may be used to attach a rod (not shown in this figure) controlled by an adjustment nut (not shown in this figure). The linkage 806 may be a rectangular bar having the first hole near one end of the bar and a second hole near the other end of the bar. The first shoulder screw 810 may be adapted with a screw length longer than a depth of the off-center tapped hole of the compensation pin 816 and a combined thickness of the linkage 806 and the rod interface 808 of which the first shoulder screw 810 penetrates. Under thermal expansion of the mounting bracket 814, the compensation pin 816 can provide lateral compensation (e.g., along its length) for the expansion and the lengthened first shoulder screw 810 can provide longitudinal compensation for the expansion.

The linkage 806 and the frame interface 802 can be held together by inserting the second shoulder screw 812 through the second hole of the linkage 806 and screwing the second shoulder screw 812 into a first hole of the frame interface 802. The frame interface 802 may be a mounting block having the first hole fitted for the second shoulder screw 812. The first hole of the frame interface 802 may be a tapped hole. The mounting block may have several other holes such that screws, pins, or nails can attach the mounting block onto the frame of the printer table, such as the supporting structure 404 of the printer table 400.

Figure 8B:
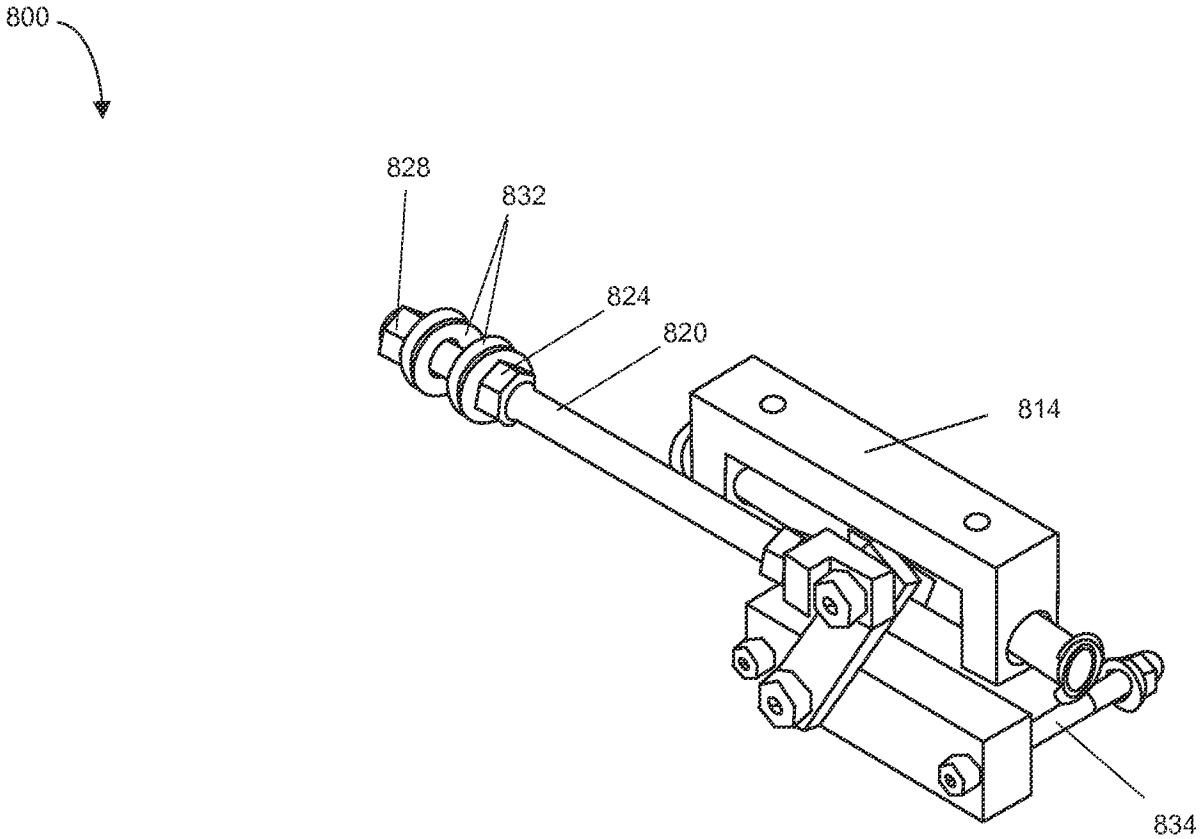
FIG. 8B is a perspective view illustrating the height adjustment mechanism of FIG. 8A after assembly and before attaching the height adjustment mechanism to a printer table.

FIG. 8B is a perspective view illustrating the height adjustment mechanism 800 of FIG. 8A after assembly and before attaching the height adjustment mechanism 800 to a printer table. The height adjustment mechanism 800 further includes a rod 820. The rod 820 may be a bolt that is fastened by a nut onto the rod interface 808 through the second hole of the rod interface 808. The second hole of the rod interface 808 may also be a tapped hole of which the rod 820 can be screwed into.

On the other end of the rod 820 may be an adjustment nut 824 and a bolt nut 828. The adjustment nut 824 may be the adjustment nut 418 of FIG. 4A. The adjustment nut 824 and the bolt nut 828 can sandwich a side plate of the printer table frame, such as one of the side plates 410 of FIG. 4A. The bolt nut 828 can be a capped nut, a locknut, a flanged nut, etc. The adjustment nut 824 is configured to be able to move the rod 820 towards or away from the frame interface 802 by rotating around the rod 820. In various embodiments, the adjustment nut 824 is turned in conjuction with the bolt nut 828 around the rod 820 on the opposite side of the side plate in order to extend or retract the rod 820 towards or away from the mounting bracket 814. Washers 832, such as flat washers, beveled washers, contact washers, lock washers, or spring washers, may be inserted between the adjustment nut 824 and the side plate, and between bolt nut 828 and the side plate. Use of the beveled washers can compensate bending of the rod 820 near the side plate. On the other hand, bending of the rod 820 that extends away from the side plate can be mitigated by positioning the linkage 806 on the outward side. This enables the linkage 806 to leverage the printer table weight and belt tension that provides a downward force which puts the rod 820 in tension.

The complete assembly of the height adjustment mechanism 800 may also include bolt assemblies 834, including one or more bolts, nuts, and washers, for attaching the height adjustment mechanism 800 to the frame of the printer table, such as the supporting structure 404 of FIG. 4A. For example, the bolt assemblies 834 may be inserted through the holes within the frame interface 802 and fastened with a bolt nut.

Figure 8C:
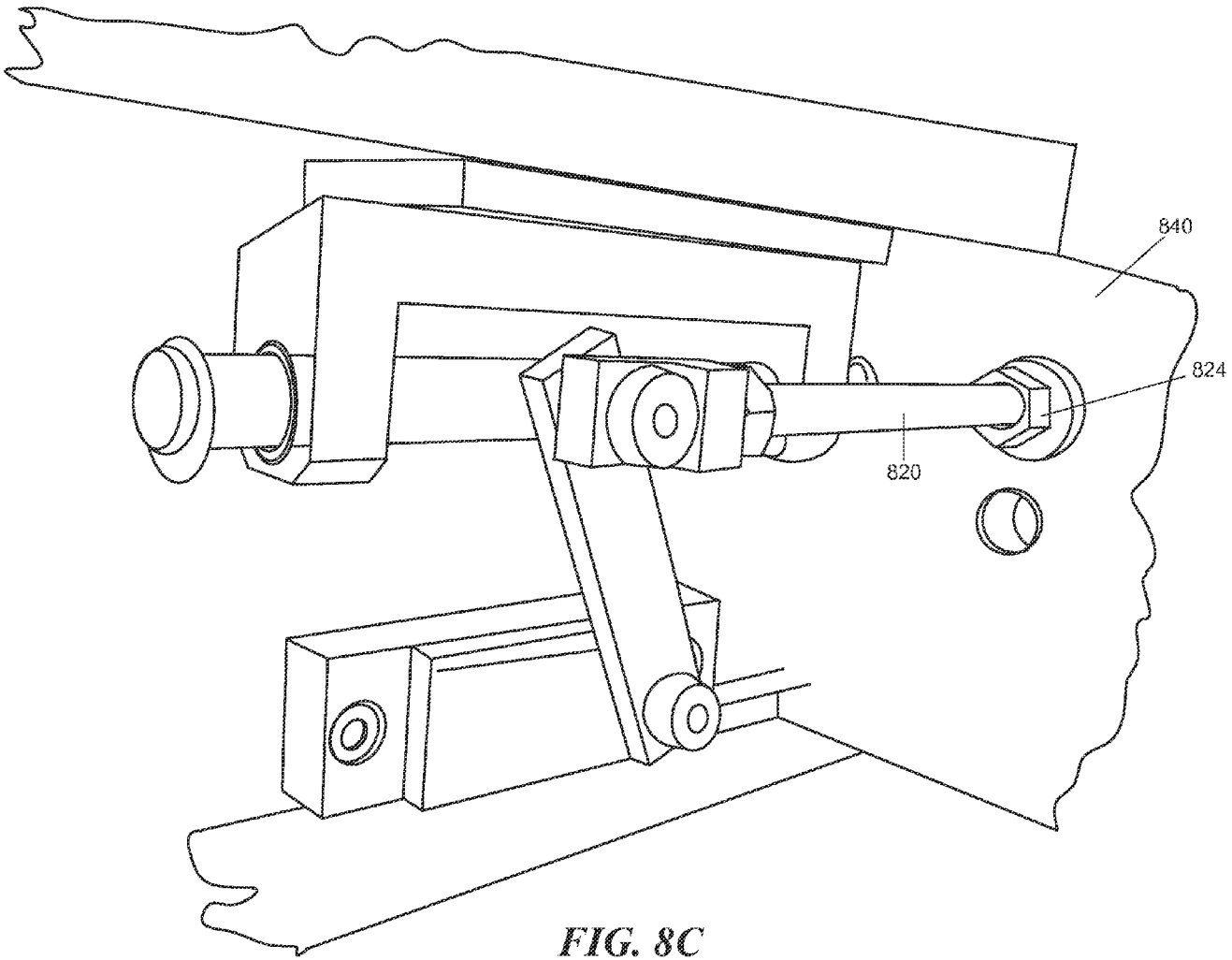
FIG. 8C is a perspective view illustrating the height adjustment mechanism of FIG. 8B after attaching the height adjustment mechanism to a side plate of the printer table.

FIG. 8C is a perspective view illustrating the height adjustment mechanism 800 of FIG. 8B after attaching the height adjustment mechanism 800 to a side plate 840 of the printer table. The side plate 840 may be one of the side plates 410 of FIG. 4A. As shown, the rod 820 is inserted through a hole in the side plate 840 with the adjustment nut 824 facing inward towards the complete assembly of the height adjustment mechanism 800.

Figure 9A:
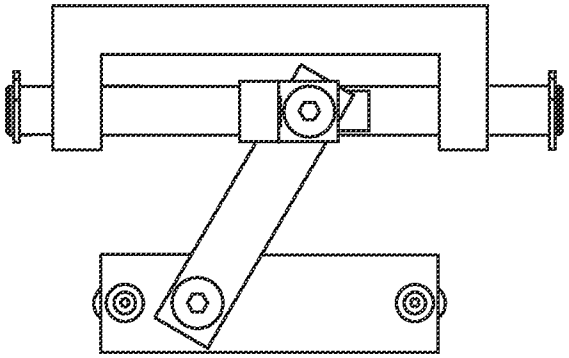
FIG. 9A is a side view of a first example of a height adjustment mechanism without illustrating the rod that extends to connect with the adjustment nut.
Figure 9B:
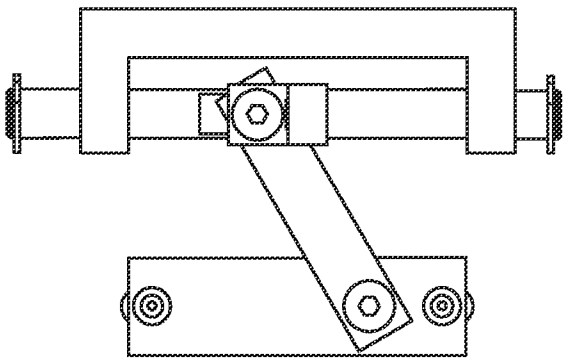
FIG. 9B is a side view of a second example of a height adjustment mechanism without illustrating the rod that extends to connect with the adjustment nut.

FIG. 9A is a side view of a first example of a height adjustment mechanism 900A without illustrating the rod that extends to connect with the adjustment nut. The height adjustment mechanism 900A may be one of the external height adjustment mechanisms 402 of FIG. 4A. The height adjustment mechanism 900A may be the height adjustment mechanism 800 of FIG. 8A. This first example is configured for the left side of the printer table. FIG. 9B is a side view of a second example of a height adjustment mechanism 900B without illustrating the rod that extends to connect with the adjustment nut. This second example is configured for the right side of the printer table.

Reference in this specification to "various embodiments" or "some embodiments" means that a particular feature, structure, or characteristic described in connection with the embodiment is included in at least one embodiment of the disclosure. Alternative embodiments (e.g., referenced as "other embodiments") are not mutually exclusive of other embodiments. Moreover, various features are described which may be exhibited by some embodiments and not by others. Similarly, various requirements are described, which may be requirements for some embodiments but not other embodiments.

What is claimed is:

1. An external table height adjustment mechanism for a printer table, the external table height adjustment mechanism comprising:

a table interface including a mounting bracket adapted to attach to a top portion of the printer table;

said mounting bracket adapted to receive a compensation pin, said compensation pin axially movable relative to said mounting bracket;

a frame mounting block adapted to attach to a supporting frame of the printer table;

a linkage structure; and a rod interface adapted to attach to a rod extending away from the frame mounting block, wherein the linkage structure is coupled to the rod interface and the compensation pin associated with the table interface at a first end of the linkage structure such that respective axial movement of said rod toward and away from said frame mounting block causes the linkage structure to pivot; and wherein the linkage structure is further coupled to the frame mounting block at an opposite end of the first end.

2. The external table height adjustment mechanism of claim 1, wherein the linkage structure includes a first hole and a second hole at opposite ends of the linkage structure; and wherein the linkage structure is coupled to the rod interface and the table interface via a first shoulder screw through the first hole and coupled to the frame mounting block via a second shoulder screw through the second hole.

3. The external table height adjustment mechanism of claim 1, wherein the frame mounting block includes holes to secure the frame mounting block to the supporting frame via screws or nails.

4. The external table height adjustment mechanism of claim 1, wherein the table interface includes holes to secure the table interface to the top portion of the printer table.

5. The external table height adjustment mechanism of claim 1, wherein the table interface includes a thermal expansion pin penetrating arms of the mounting bracket.

6. The external table height adjustment mechanism of claim 5, wherein the linkage structure is coupled to the table interface by coupling with the thermal expansion pin of the table interface.

7. The external table height adjustment mechanism of claim 5, further comprising a shoulder screw; wherein the thermal expansion pin includes an off-center tapped hole to secure the shoulder screw that couples the linkage structure to the thermal expansion pin and the rod interface.

8. The external table height adjustment mechanism of claim 7, wherein the shoulder screw is adapted with a screw length longer than a depth of the off-center tapped hole and a combined thickness of the linkage structure and the rod interface of which the shoulder screw penetrates.

* * * * *